US011724522B2

(12) United States Patent
Sasaki et al.

(10) Patent No.: US 11,724,522 B2
(45) Date of Patent: Aug. 15, 2023

(54) DRYING DEVICE, PRINTING SYSTEM

(71) Applicant: Seiko Epson Corporation, Tokyo (JP)

(72) Inventors: Tsuneyuki Sasaki, Matsumoto (JP); Tadashi Aizawa, Matsumoto (JP); Katsuya Asamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/651,190

(22) Filed: Feb. 15, 2022

(65) Prior Publication Data

US 2022/0258496 A1 Aug. 18, 2022

(30) Foreign Application Priority Data

Feb. 18, 2021 (JP) ..... 2021-024013

(51) Int. Cl.
*B41J 11/00* (2006.01)

(52) U.S. Cl.
CPC ..... *B41J 11/0022* (2021.01)

(58) Field of Classification Search
CPC ..... B41J 11/0022; B41J 11/002; B41J 2/01; B41J 11/0095
See application file for complete search history.

(56) References Cited

U.S. PATENT DOCUMENTS

2015/0202893 A1 7/2015 Hara et al.
2015/0352840 A1 12/2015 Hara
2019/0299653 A1* 10/2019 Lang ..... B41J 2/1433

FOREIGN PATENT DOCUMENTS

JP 2010-000762 1/2010
JP 2015-134469 7/2015
JP 2015-229261 12/2015
JP 2017-114001 6/2017

* cited by examiner

*Primary Examiner* — Bradley W Thies
(74) *Attorney, Agent, or Firm* — Workman Nydegger

(57) ABSTRACT

A drying device that dries a medium being transported, the drying device includes a support that supports a medium being transported, an AC electric field generation unit that generates an AC electric field, a detector that detects an amount of moisture contained in the medium, and a control unit, wherein the AC electric field generation unit has first electrode and second electrodes disposed adjacent to each other and facing the medium supported by the support, a high-frequency voltage generator that generates a high-frequency voltage at the first and second electrodes, and a conductor that electrically couples the first electrode and the second electrode to the high-frequency voltage generator, and the detector is disposed at least one of downstream or upstream of the first and second electrodes in a transporting direction, and the control unit controls the AC electric field generation unit in accordance with a detection result of the detector.

7 Claims, 10 Drawing Sheets

DRYING DEVICE, PRINTING SYSTEM

The present application is based on, and claims priority from JP Application Serial Number 2021-024013, filed Feb. 18, 2021, the disclosure of which is hereby incorporated by reference herein in its entirety.

BACKGROUND

1. Technical Field

The present disclosure relates to a drying device and a printing system.

2. Related Art

In the related art, as shown in JP A-2017-114001, a drying device is known provided with a heating unit that irradiates a liquid discharged onto a medium with electromagnetic waves.

SUMMARY

However, in a device that heats an object by irradiating with electromagnetic waves, such as the above-described drying device, if heating is continued in a state where there is no moisture or the like contained in the target, there is a problem that the generator that generates the electromagnetic waves malfunctions.

A drying device that dries a medium being transported, the drying device including a support that supports a medium being transported, an AC electric field generation unit that generates an AC electric field, a detector that detects an amount of moisture contained in the medium, and a control unit, wherein the AC electric field generation unit has a first electrode and a second electrode facing the medium supported by the support and disposed adjacent to each other, a high-frequency voltage generator that generates a high-frequency voltage at the first electrode and the second electrode, and a conductor that electrically couples the first electrode and the second electrode to the high-frequency voltage generator, and the detector is disposed at least one of downstream or upstream of the first electrode and the second electrode in a transporting direction, and the control unit controls the AC electric field generation unit in accordance with a detection result of the detector.

A printing system includes the drying device and a printing device for applying a liquid to a medium, wherein the drying device dries the medium to which the liquid has been applied by the printing device.

DESCRIPTION OF EMBODIMENTS

First, configuration of a printing system 1 will be described.

Figure 1:
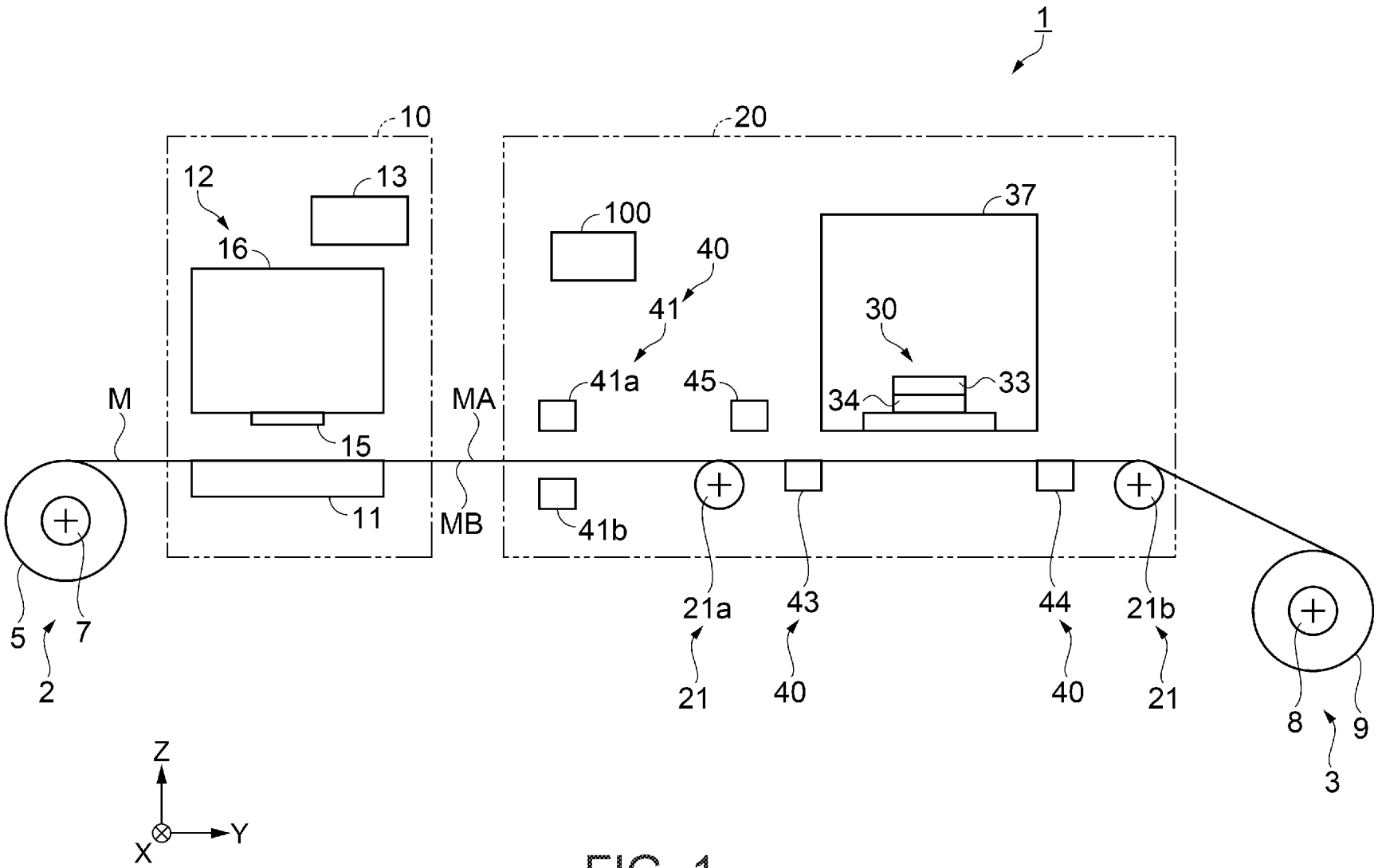
FIG. 1 is a schematic diagram showing configuration of a printing system.

As shown in FIG. 1, the printing system 1 includes a holding device 2, a winding device 3, a printing device 10, and a drying device 20.

The holding device 2 is a device that holds a roll body 5 on which a sheet-shaped medium M is wound. The holding device 2 has a holding shaft 7 for holding the roll body 5. The holding shaft 7 is configured to be rotatable, for example. As the holding shaft 7 rotates, the medium M is fed out from the roll body 5. The medium M is, for example, a sheet such as paper or fabric.

The winding device 3 is a device that winds the medium M fed from the holding device 2. The winding device 3 includes a winding shaft 8 that winds the medium M. The winding shaft 8 is configured to be driven to rotate. The winding shaft 8 winds the medium M by being driven and rotated. As a result, the winding shaft 8 holds a roll body 9 formed by winding the medium M. In this embodiment, the medium M is fed out from the roll body 5 held by the holding shaft 7 by driving and rotating the winding shaft 8.

The medium M is transported by being wound up by the winding device 3. The medium M is transported from the holding device 2 to the winding device 3 via the printing device 10 and the drying device 20. The transporting direction of the medium M is a direction from the holding device 2 toward the winding device (a direction following the +Y direction). The medium M has a front face MA and a back face MB which is a surface opposite to the front face MA.

The printing device 10 is an apparatus that performs printing on a medium M by applying liquid (for example, ink) to the medium M. The printing device 10 is, for example, an ink jet printer that records (prints) an image such as a character, a photograph, or a figure by ejecting ink onto a medium M.

The printing device 10 is located between the holding device 2 and the winding device 3 in the transporting direction. The printing device 10 is disposed upstream of the drying device 20 in the transporting direction. That is, the medium M fed from the holding device 2 passes through the printing device 10 and the drying device 20 in this order.

The printing device 10 includes a platen 11, a printing unit 12, and a control unit 13.

The platen 11 is a plate-like member. The platen 11 supports the medium M being transported. The platen 11 supports the medium M from below. The platen 11 contacts the back face MB of the medium M.

The printing unit 12 faces the platen 11. The printing unit 12 is located above the platen 11. The printing unit 12 includes a head 15 and a carriage 16.

The head 15 faces the platen 11. The head 15 is located above the platen 11. The head 15 ejects liquid toward the front face MA of the medium M supported by the platen 11. As a result, an image is printed on the medium M. The liquid ejected by the head 15 is, for example, water-based ink using water as a solvent.

When the head 15 ejects liquid onto the medium M, the amount of moisture contained in the medium M increases. That is, the head 15 performs a process of increasing the amount of moisture contained in the medium M by ejecting liquid onto the medium M.

The head 15 is mounted on the carriage 16. The carriage faces the platen 11. The carriage 16 is located above the platen 11. The carriage 16 reciprocates in a direction along the X-axis with respect to the medium M being transported. That is, the carriage 16 reciprocates over the width direction of the medium M above the platen 11.

The printing device 10 is a serial-type printer in which the head 15 reciprocates with respect to the medium M. Note that, the printing device 10 may be a line-type printer in which the head 15 ejects liquid all at once across the width direction of the medium M.

The control unit 13 controls each driving unit of the printing device 10. The control unit 13 includes a CPU, a memory, a control circuit, and an interface (I/F). The CPU is an arithmetic processing unit. The memory is a storage device that secures an area for storing a program of the CPU, a work area, or the like, and includes a storage element such as a RAM, an EEPROM or the like. When recording data or the like is acquired externally from an information processing terminal or the like via an I/F, the CPU controls driving units of, for example, the printing unit 12 via a control circuit.

The control unit 13 can communicate with the holding device 2, the winding device 3, and the drying device 20. As necessary, the control unit 13 receives signals from the holding device 2, the winding device 3, and the drying device 20 and transmits signals to the holding device 2, the winding device 3, and the drying device 20 (control unit 100).

In the printing device 10, a pretreatment unit that applies a pretreatment liquid to the front face MA of the medium M may be disposed upstream of the printing unit 12 in the transporting direction. By the preprocessing in the preprocessing unit of processing the medium M before printing, it is possible to improve the permeability of the liquid discharged to the medium M during printing, and to improve print quality such as color development of the image printed on the medium M and the durability of the medium M.

Next, configuration of the drying device 20 will be described.

The drying device 20 is a device that dries the medium M that is transported. The drying device 20 is disposed downstream of the printing device 10 in the transporting direction and dries the medium M on which liquid has been applied by the printing device 10.

As shown in FIG. 1, the drying device 20 includes a support 21, an AC electric field generation unit 30, a detector 40, and the control unit 100.

The support 21 supports the medium M being transported. In this embodiment, a pair of transport rollers 21*a*, 21*b* are provided. Each of the transport rollers 21*a*, 21*b* extends in a direction along the X-axis. One transport roller 21*a* is disposed upstream of the other transport roller 21*b* in the transporting direction. Each of the transport rollers 21*a*, 21*b* supports the back face MB of the medium M. Each of the transport rollers 21*a*, 21*b* is a driven roller, and is driven to rotate in association with the winding operation of the medium M by the winding device 3.

The AC electric field generation unit 30 dries the medium M. Specifically, by generating an AC electric field, the AC electric field generation unit 30 performs a process of heating moisture contained in the medium M and reduces the amount of moisture contained in the medium M. That is, the AC electric field generation unit 30 heats the liquid applied to the medium M supported by the support 21 and dries the medium M. The AC electric field generation unit 30 is disposed between the transport roller 21*a* and transport roller 21*b* in the transporting direction.

The AC electric field generation unit 30 heats the liquid by generating an AC electric field of 2.4 GHz. Note that, for example, Joule's heat due to eddy currents generated in the liquid applied to the medium M by generating an AC electric field of 3 MHz to 300 MHz may be used, or dielectric heating due to frictional heat of molecular vibration by generating an AC electric field of 300 MHz to 30 GHz may be used, and among these, it is preferable to generate an AC electric field of 10 MHz to 20 GHz.

Figure 2:
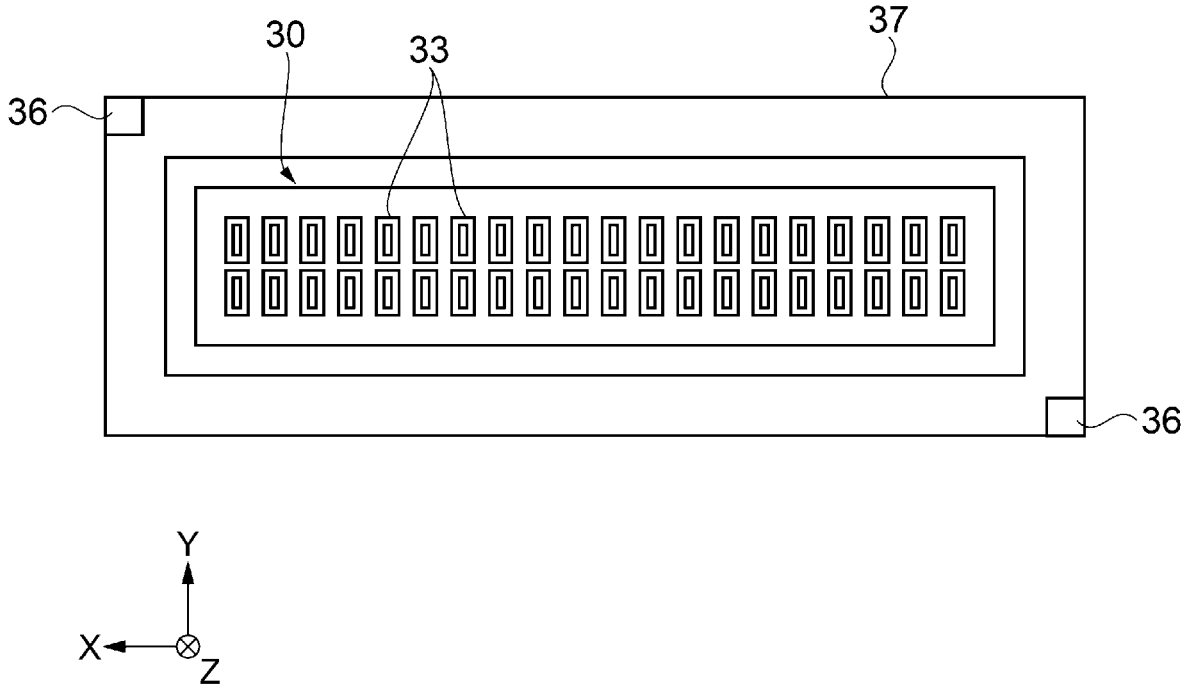
FIG. 2 is a schematic diagram showing configuration of an AC electric field generation unit.

As shown in FIG. 2, the AC electric field generation unit 30 includes a plurality of generators 33 for generating the AC electric field. The generators 33 are arranged to extend in a direction along the X-axis. The dimension of the plurality of generators 33 along the X-axis is longer than the dimension of the medium M in the direction along the X-axis. The generators 33 form a plurality of rows in the direction along the X-axis.

The generators 33 are disposed in a housing 37 so that the AC electric field generated by the generators 33 does not affect the outside. The housing 37 is a box body whose lower side is opened. The generators 33 are disposed facing the opening of the housing 37 so as to face the front face MA of the medium M supported by the support 21.

It is preferable that the distance, in the direction along the Z-axis, between the −Z direction end portion of the housing 37 and the medium M is about 1 mm to 20 mm. Accordingly, it is possible to suppress entry of a user's finger or the like into a space between the housing 37 and the medium M.

An electric field detection sensor 36 is mounted on the housing 37. In the present embodiment, the electric field detection sensor 36 is configured to include a pair of electric field detection antennas that detect the AC electric field. The electric field detection sensor 36 faces the medium M in the direction along the Z-axis. The electric field detection sensor 36 is disposed at an end portion of the housing 37. Specifically, one of the pair of electric field detection antennas is disposed at one corner of the housing 37, and the other electric field detection antenna is disposed at a corner that is diagonal to the corner of the housing 37 where the one electric field detection antenna is disposed. In this manner, the electric field detection sensor 36 is disposed such that the electric field detection antennas are located at positions separated from the generators 33 and the electric field detection sensor 36 can detect a change in the AC electric field generated from the AC electric field generation unit 30.

Figure 3:
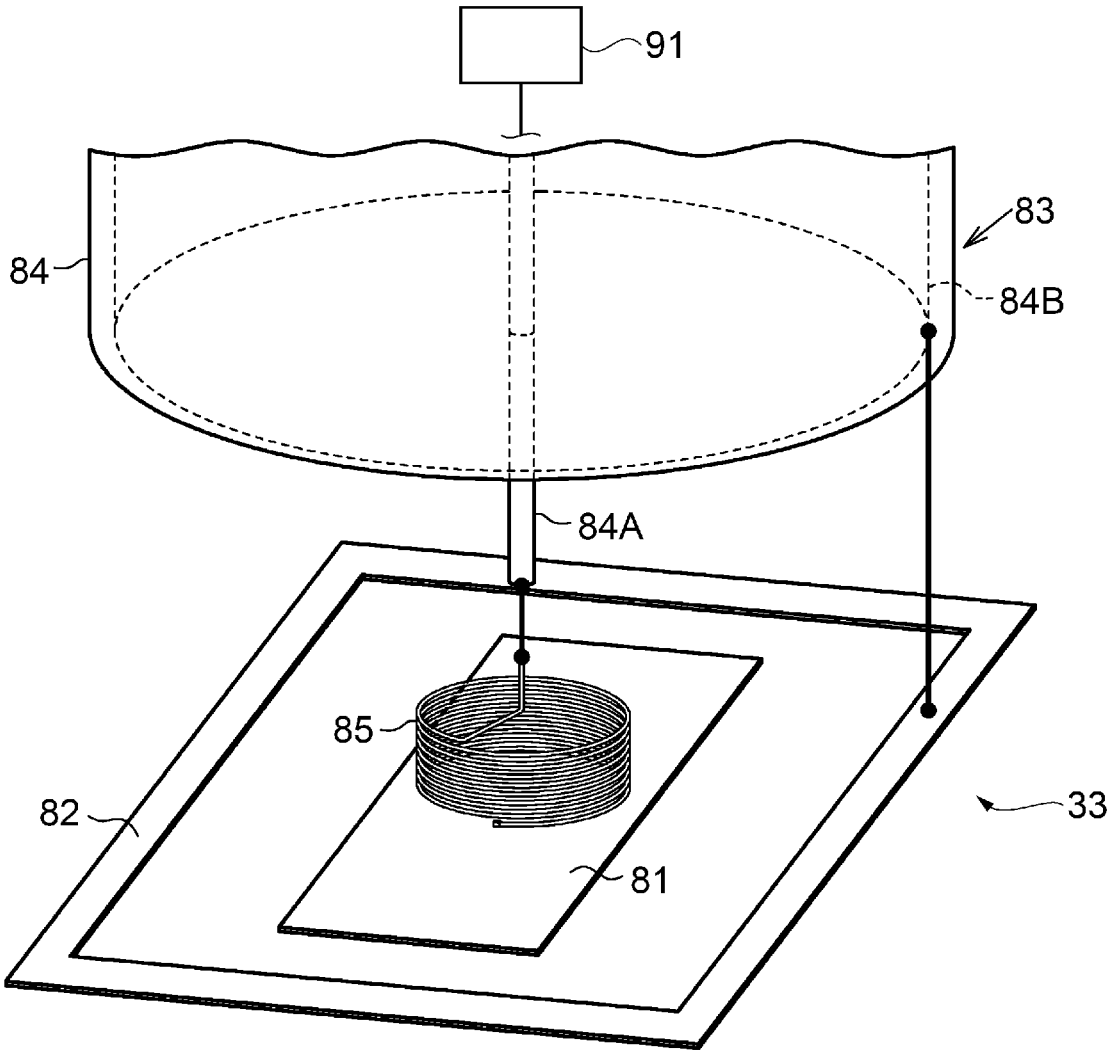
FIG. 3 is a schematic diagram showing configuration of the AC electric field generation unit.

As shown in FIG. 3, the generators 33 include a first electrode 81, a second electrode 82, and a conductor 83. The first electrode 81 is a flat plate having a rectangular shape in plan view. The first electrode 81 faces the medium M supported by the support 21. The first electrode 81 is disposed above the medium M. The second electrode 82 is a hollow rectangular flat plate surrounding the first electrode 81 in plan view. The second electrode 82 faces the medium M supported by the support 21. The second electrode 82 is disposed above the medium M. The first electrode 81 and the second electrode 82 are disposed adjacent to each other.

The conductor 83 electrically couples the first electrode 81 and the second electrode 82 to a high-frequency voltage generator 91 that generates a high-frequency voltage. The conductor 83 includes a coaxial cable 84 and a coil 85. The coaxial cable 84 has an inner conductor 84A and an outer conductor 84B. The inner conductor 84A is coupled to the first electrode 81 via the coil 85, and electrically couples the high-frequency voltage generator 91 and the first electrode 81. The outer conductor 84B is coupled to the second electrode 82, and electrically couples the high-frequency voltage generator 91 and the second electrode 82. The coil 85 as an example of a winding is coupled between the first electrode 81 and the inner conductor 84A of the coaxial cable 84, and the coil 85 is preferably disposed at a position as close as possible to the first electrode 81.

The minimum separation distance between the first electrode 81 and the second electrode 82 is equal to or less than 1/10 of the wavelength of the AC electric field output from the AC electric field generation unit 30. Further, the first electrode 81 and the second electrode 82 are point symmetrical with respect to the center of the first electrode 81. As a result, the electric field generated between the first electrode 81 and the second electrode 82 cancels out the electric field generated at the point-symmetrical position, so that most of the AC electric field generated when a high-frequency voltage is applied can be attenuated in the vicinity of the first electrode 81 and the second electrode 82. This makes it possible to reduce the intensity of electromagnetic waves that reach a remote distance from the first electrode 81 and the second electrode 82. That is, the AC electric field generated from the AC electric field generation unit 30 is extremely strong near the first electrode and the second electrode 82, and the AC electric field is extremely weak at a remote distance from these electrodes.

The generators 33 can intensively generate the AC electric field in a range in the vicinity of the first electrode 81 and the second electrode 82, for example, in a 3 mm to 3 cm range, by appropriately controlling the band of frequencies of the generated AC electric field and so make it less likely for the AC electric field to influence beyond this range.

In addition, in the generators 33, it is possible to concentrate the AC electric field in the vicinity of the first electrode 81 and the second electrode 82, it is possible to improve heating efficiency of the liquid discharged to the medium M supported by the support 21, and it is possible to improve drying efficiency of the medium M. On the other hand, it is possible to make it difficult for the AC electric field to be generated at a position separated from the first electrode 81 and the second electrode 82, and it is not necessary to excessively dispose members for suppressing the alternating electric field, and it is possible to improve workability in the drying device 20. In addition, an increase in the size of the drying device 20 can be suppressed.

As shown in FIG. 1, facing surfaces of the first electrode 81 and the second electrode 82 of the generators 33 that face the medium M are covered with a cover 34. The cover 34 is disposed below the generators 33. Since the generators 33 are covered by the cover 34, adhesion of foreign matter to the first electrode 81 and the second electrode 82 is suppressed.

The cover 34 is formed of a material that transmits the AC electric field generated by the AC electric field generation unit 30. Specifically, the cover 34 is formed of glass. Note that the material is not limited to this, and the cover 34 may be formed of a resin having transmissivity such as a cyclic olefin copolymer, for example and is preferably a material that is less likely to be affected by dielectric heating. The surface of the cover 34 on the −Z direction side has an uneven shape, and can converge the AC electric field generated from the AC electric field generation unit 30 toward the medium M supported by the support 21.

The drying device 20 includes an adjustment mechanism (FIG. 4) capable of moving the generators 33 and the cover 34 in a direction along the Z-axis. Thus, the distance between the generators 33 and the medium M can be adjusted. The adjustment mechanism 88 may be, for example, a link mechanism or a rack and pinion mechanism. Therefore, it is possible to easily adjust the distance between the generators 33 and the medium M according to the type of medium M, the type of liquid ejected from the head 15, or the like.

Figure 4:
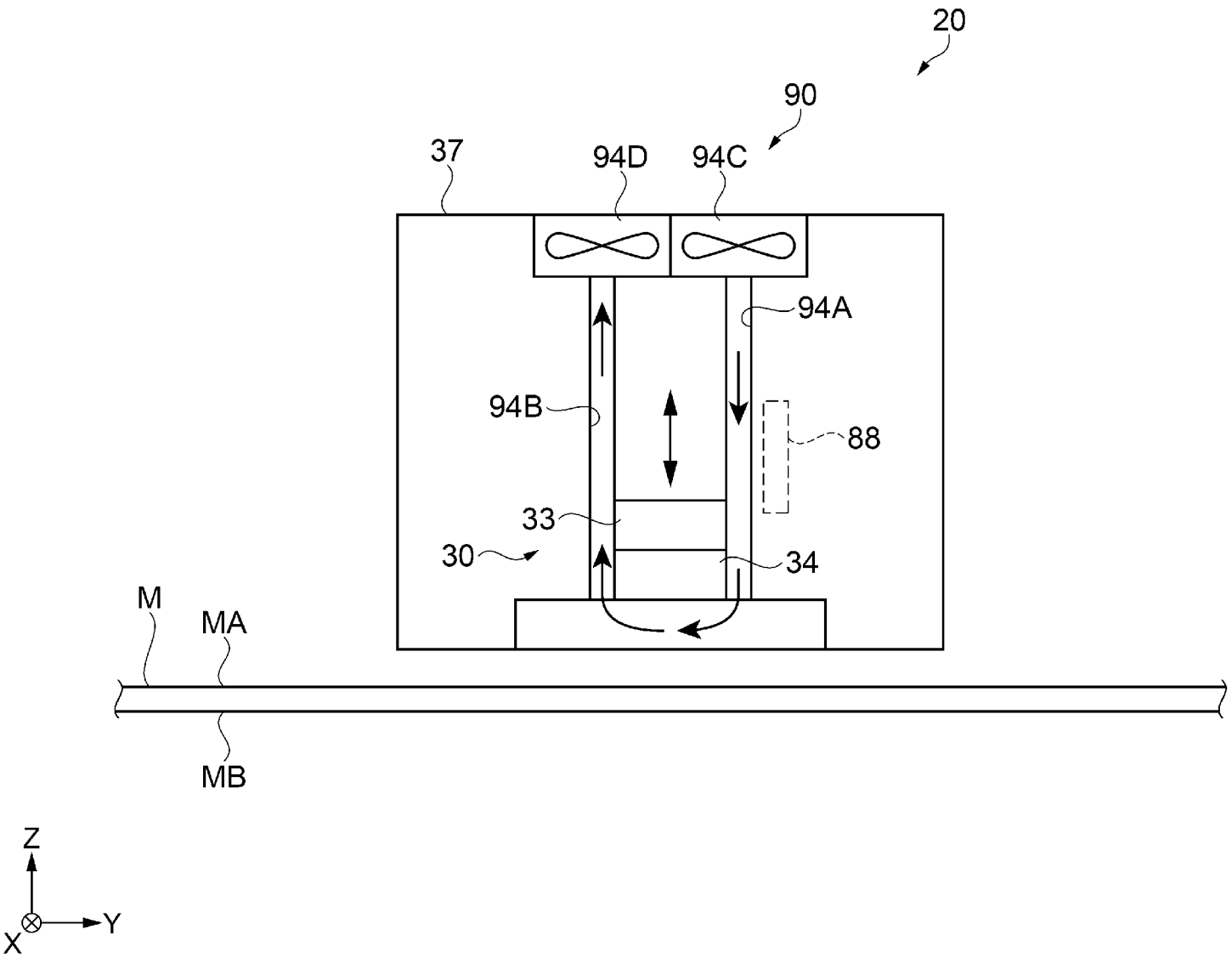
FIG. 4 is a schematic diagram showing configuration of a blower.

As shown in FIG. 4, the drying device 20 includes a blower 90 that blows air to the generators 33 (the first electrode 81 and the second electrode 82). The blower 90 is mounted on the housing 37. The blower 90 includes a first passage 94A, a second passage 94B, a first blower fan 94C, and a second blower fan 94D.

The first passage 94A is a passage extending in the direction along the Z-axis so as to be adjacent to the generators 33 in between the generators 33 and the outer edge of the housing 37. The second passage 94B is a passage extending in the direction along the Z-axis so as to be adjacent to the generators 33 on the −Y-direction side of the generators 33.

The first blower fan 94C is disposed at an upper end of the first passage 94A. The first blower fan 94C is a fan that blows air from the outside of the housing 37 into the first passage 94A. The second blower fan 94D is disposed at an upper end of the second passage 94B of the housing 37. The second blower fan 94D is a fan that blows air from the second passage 94B to outside the housing 37.

Air is taken in from outside of the housing 37 by driving the first blower fan 94C, and the air is blown into the first passage 94A, and blown out of the housing 37 from the second passage 94B by driving the second blower fan 94D. Accordingly, gas flows from the first passage 94A to pass below the cover 34 and to pass through the second passage 94B. As described above, the blower 90 blows air to the generators 33 including the coil 85, the first electrode 81, and the second electrode 82. As a result, the generators 33 including the coil 85, the first electrode 81, and the second electrode 82 are cooled.

Further, the gas sent by the first blower fan 94C is heated by the generators 33. The heated gas is blown to the medium M supported by the support 21. As a result, the liquid applied to the medium M is warmed, and drying of the medium M can be promoted.

The detector 40 detects the amount of moisture contained in the medium M. The detector 40 according to the present embodiment detects the amount of moisture contained in the ink of the medium M that has passed through the printing device 10. The detector 40 is disposed on at least one of downstream or upstream in the transporting direction of the first electrode 81 and the second electrode 82.

As shown in FIG. 1, the detector 40 of the present embodiment includes an ultrasonic sensor 41 and capacitance sensors 43, 44. Although one ultrasonic sensor 41 is provided in this embodiment, two or more ultrasonic sensors 41 may be provided. Further, although two capacitance sensors 43 and 44 are provided, three or more capacitance sensors may be provided, or only one capacitance sensor may be provided.

The detector 40 according to the present embodiment further includes an optical sensor 45.

The ultrasonic sensor 41 is disposed upstream of the generators 33 (the first electrode 81 and the second electrode 82) in the transporting direction.

Figure 5A:
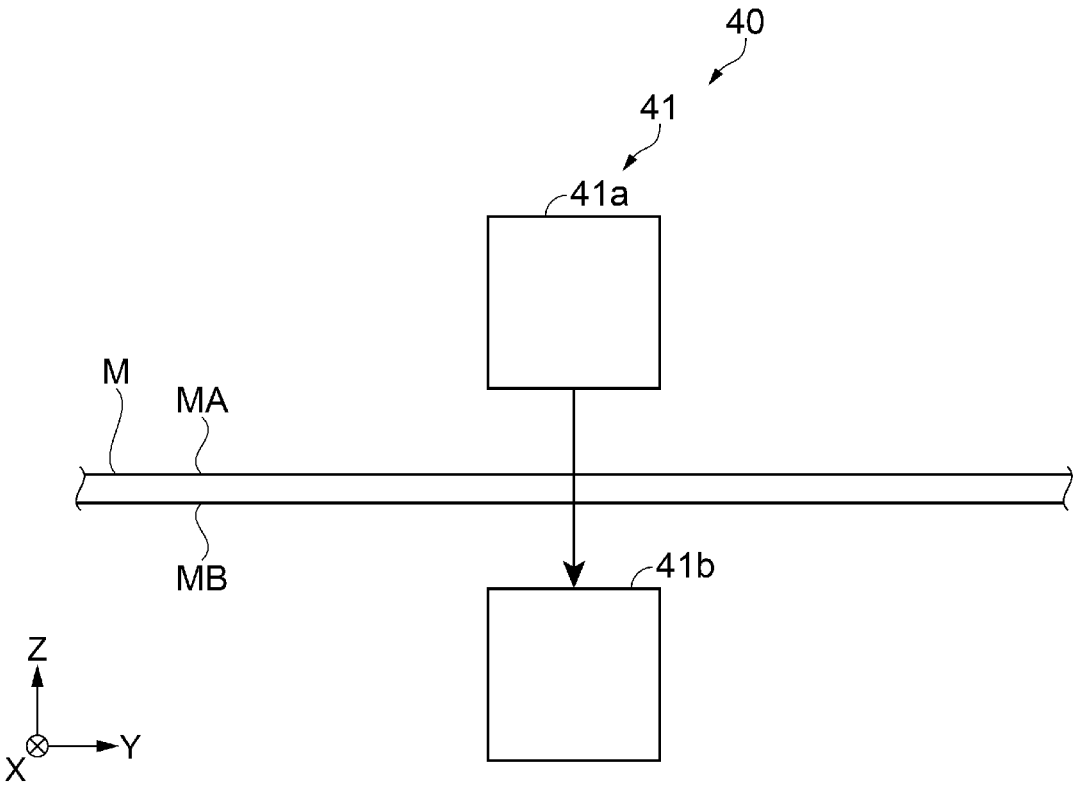
FIG. 5A is a schematic diagram showing configuration of a detector (ultrasonic sensor).

As illustrated in FIG. 5A, the ultrasonic sensor 41 includes a transmitting unit 41*a* and a receiving unit 41*b*. The transmitting unit 41*a* and the receiving unit 41*b* are disposed so as to sandwich the medium M being transported. The transmitting unit 41*a* and the receiving unit 41*b* are disposed so as to sandwich in the vertical direction the medium M being transported. That is, the medium M is transported while passing between the transmitting unit 41*a* and the receiving unit 41*b*.

The transmitting unit 41*a* is disposed above (+Z direction) the receiving unit 41*b*. The transmitting unit 41*a* transmits ultrasonic waves toward the receiving unit 41*b*. That is, the transmitting unit 41*a* transmits ultrasonic waves downward (in the −Z direction). Therefore, when the medium M is positioned between the transmitting unit 41*a* and the receiving unit 41*b*, the ultrasonic waves transmitted from the transmitting unit 41*a* are irradiated on the medium M. At this time, the medium M before drying is irradiated with the ultrasonic waves transmitted from the transmitting unit 41*a*. When the medium M is not positioned between the transmitting unit 41*a* and the receiving unit 41*b*, the ultrasonic waves transmitted from the transmitting unit 41*a* are directly irradiated to the receiving unit 41*b*.

The receiving unit 41*b* receives the ultrasonic waves transmitted by the transmitting unit 41*a*. Therefore, when the medium M is positioned between the transmitting unit 41*a* and the receiving unit 41*b*, the receiving unit 41*b* receives ultrasonic waves transmitted from the transmitting unit 41*a* and transmitted through the medium M. At this time, the receiving unit 41*b* receives the ultrasonic waves transmitted through the medium M before drying. In a case where the medium M is not positioned between the transmitting unit 41*a* and the receiving unit 41*b*, the receiving unit 41*b* directly receives the ultrasonic waves transmitted from the transmitting unit 41*a*.

The ultrasonic waves transmitted from the transmitting unit 41*a* are attenuated by passing through the medium M. Therefore, when the medium M is positioned between the transmitting unit 41*a* and the receiving unit 41*b*, the intensity of the ultrasonic waves received by the receiving unit 41*b* is lower than that in a case where the medium M is not positioned between the transmitting unit 41*a* and the receiving unit 41*b*. The degree of attenuation of the ultrasonic waves transmitted through the medium M varies depending on the density, thickness, and the like of the medium M.

The transmittance of the ultrasonic waves with respect to the medium M is detected based on the intensity of the ultrasonic waves received by the receiving unit 41*b* when the medium M is positioned between the transmitting unit 41*a* and the receiving unit 41*b* and the intensity of the ultrasonic waves received by the receiving unit 41*b* when the medium M is not positioned between the transmitting unit 41*a* and the receiving unit 41*b*. The transmittance of the ultrasonic waves with respect to the medium M is a ratio of the ultrasonic waves transmitted through the medium M to the ultrasonic waves transmitted by the transmitting unit 41*a*.

There is a correlation between the transmittance of ultrasonic waves with respect to the medium M and the basis weight of the medium M. For example, the greater the transmittance of ultrasonic waves with respect to the medium M, the smaller the basis weight of the medium M. The smaller the transmittance of the ultrasonic waves with respect to the medium M, the greater the basis weight of the medium M. In this manner, the basis weight of the medium M is detected based on the transmittance of the ultrasonic waves with respect to the medium M. Therefore, the ultrasonic sensor 41 is a sensor that detects the basis weight of the medium M. The control unit 100 calculates the basis weight of the medium M based on the signal transmitted from the ultrasonic sensor 41.

A configuration in which the thickness of the medium M is calculated based on a signal transmitted from the ultrasonic sensor 41 may be added.

Figure 5B:
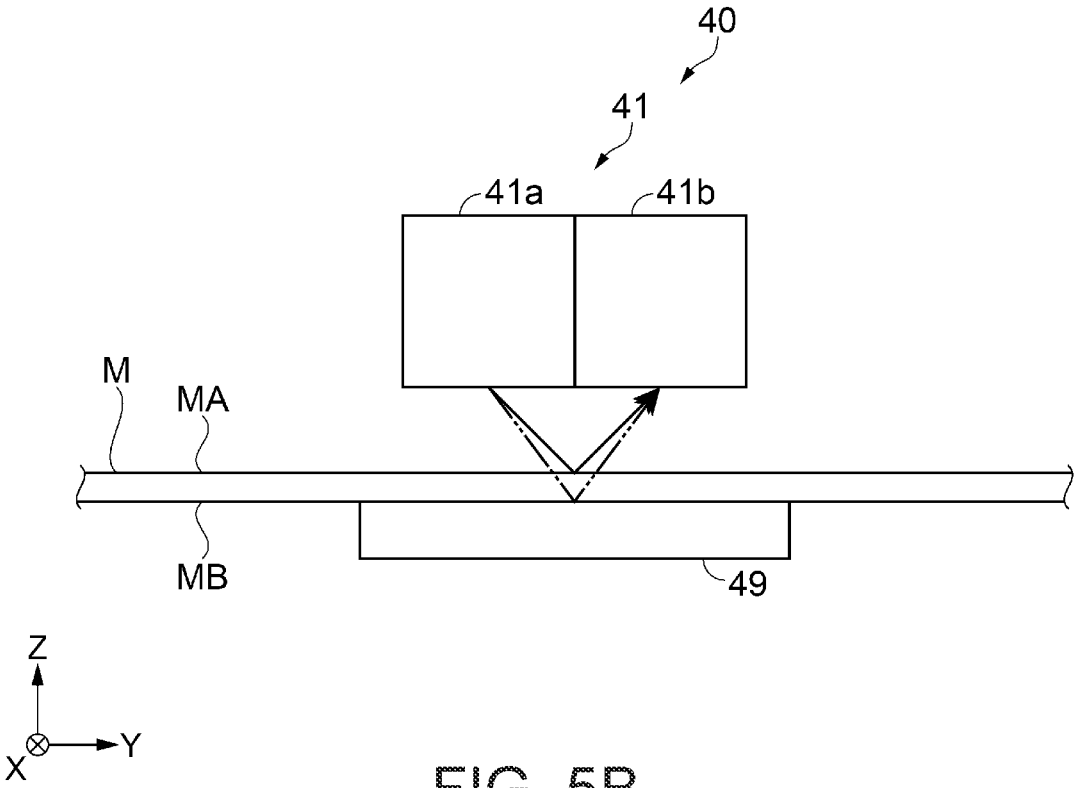
FIG. 5B is a schematic diagram showing configuration of another detector (ultrasonic sensor).

To be specific, as illustrated in FIG. 5B, the transmitting unit 41*a* and the receiving unit 41*b* are disposed above the medium M. Ultrasonic waves are transmitted from the transmitting unit 41*a* toward the medium M, and the receiving unit 41*b* receives the ultrasonic waves reflected by the medium M. A support body 49 having a support surface that supports the medium M is provided at the back face MB side of the medium M reflecting ultrasonic waves transmitted from the transmitting unit 41*a*. Accordingly, the ultrasonic waves transmitted from the transmitting unit 41*a* are reflected by the front face MA of the medium M and by the support surface, and the receiving unit 41*b* receives the ultrasonic waves reflected by the front face MA of the medium M and by the support surface. Then, the difference is detected between 1) the time from when the transmitting unit 41*a* transmits the ultrasonic waves to when the ultrasonic waves reflected by the front face MA of the medium M are received and 2) the time from when the transmitting unit 41*a* transmits the ultrasonic waves to when the ultrasonic waves reflected by the support surface are received. By converting the time difference into a distance, the thickness of the medium M can be detected.

As shown in FIG. 1, the capacitance sensor 43 is disposed upstream of the generators 33 (the first electrode 81 and the second electrode 82) in the transporting direction, and the capacitance sensor 44 is disposed downstream of the generators 33 (the first electrode 81 and the second electrode 82) in the transporting direction.

Figure 6:
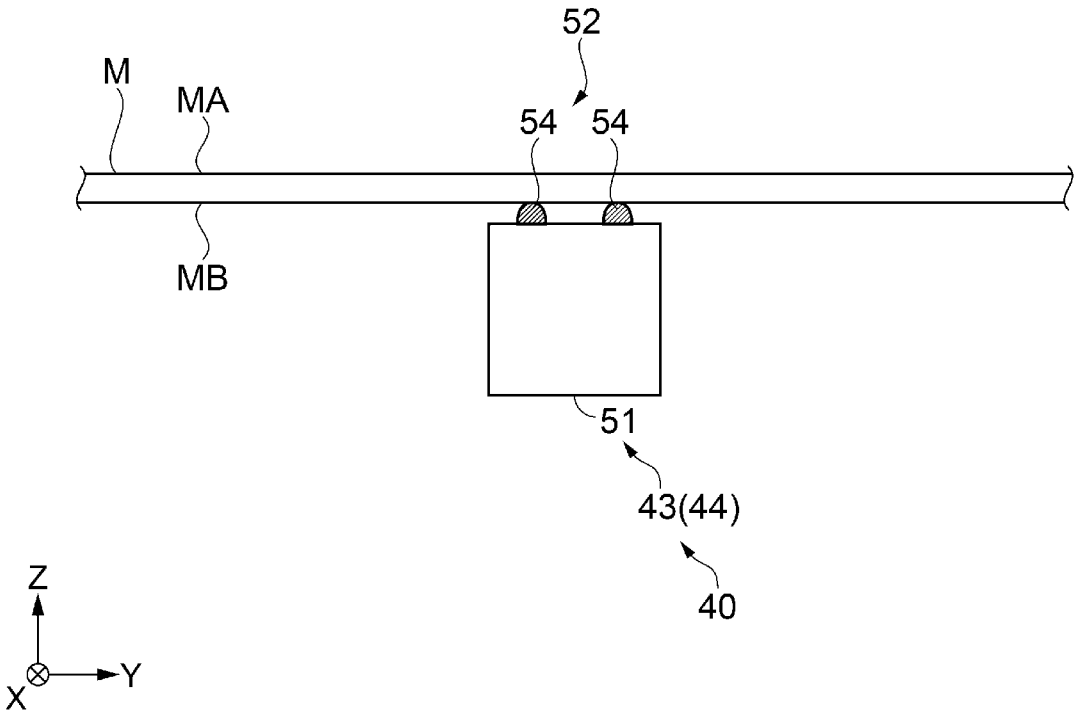
FIG. 6 is a schematic diagram showing configuration of a detector (capacitance sensor).

As shown in FIG. 6, the capacitance sensor 43 is disposed below the medium M. The capacitance sensor 43 contacts the medium M from below. The capacitance sensor 43 detects the capacitance of the medium M by contacting the medium M. The capacitance sensor 43 detects the capacitance of the medium M before drying by the AC electric field generation unit 30.

The capacitance sensor 43 includes a holding portion 51 and an electrode pair 52. The holding portion 51 holds the electrode pair 52. The shape of the holding portion 51 is, for example, a rectangular parallelepiped or a rectangular parallelepiped shape.

The electrode pair 52 protrudes from the upper surface of the holding portion 51 in the +Z direction. The electrode pair contacts the medium M being transported. In the present embodiment, the electrode pair 52 contacts the back face MB of the medium M. This reduces the risk of damaging the printed front face MA compared to the case where the electrode pair 52 contacts the front face MA of the medium M.

The electrode pair 52 constitutes a part of an oscillation circuit included in the capacitance sensor 43. The electrode pair 52 includes two electrodes 54. An AC voltage is applied between the two electrodes 54. That is, the capacitance sensor 43 detects the capacitance between the two electrodes 54. When the two electrodes 54 contact the medium M, an AC voltage flows through the medium M. Thus, the capacitance sensor 43 detects the capacitance of the medium M contacted by the electrode pair 52.

The electrode pair 52 contacts the medium M after the liquid is ejected by the head 15. For this reason, the capacitance sensor 43 detects the capacitance of the medium M containing moisture.

When an AC voltage flows from the two electrodes 54 to the medium M, the capacitance between the two electrodes 54 changes. At this time, the change in the capacitance between the two electrodes 54 is greatly affected by the amount of moisture contained in the medium M contacted by the two electrodes 54. The reason for this is that the relative permittivity of water is higher than that of the medium M in which paper, fabric, or the like is employed. Therefore, for example, when the amount of moisture contained in the medium M is large, the change in capacitance between the two electrodes 54 becomes large. When the amount of moisture contained in the medium M is small, the change in capacitance between the two electrodes 54 becomes small. As described above, there is a correlation between the change in capacitance between the two electrodes 54 and the amount of moisture contained in the medium M.

The change in capacitance between the two electrodes 54 is affected by the basis weight of the medium M contacted by the two electrodes 54. For example, when the basis weight of the medium M is large, the change in capacitance between the two electrodes 54 becomes large. When the basis weight of the medium M is small, the change in capacitance between the two electrodes 54 is small.

The position of the holding portion 51 can be adjusted in a direction along the X-axis and the Z-axis by a screw or the like. As a result, the position of the electrode pair 52 is adjusted so that the electrode pair 52 reliably contacts the medium M. Thus, the capacitance can be detected with high accuracy.

The other capacitance sensor 44 is disposed below the medium M. The capacitance sensor 44 contacts the medium M from below. The capacitance sensor 44 detects the capacitance of the medium M by contacting the medium M. Since the configuration of the capacitance sensor 44 is the same as that of the capacitance sensor 43, the description thereof will be omitted. The capacitance sensor 44 detects the capacitance of the medium M after drying by the AC electric field generation unit 30.

As described above, the amount of moisture contained in the medium M is accurately detected based on the ultrasonic sensor 41 and the capacitance sensors 43, 44. The control unit 100 may calculate the amount of moisture contained in the medium M based on the signal transmitted from the ultrasonic sensor 41 and the signal transmitted from the capacitance sensor 43.

The optical sensor 45 detects the amount of moisture contained in the medium M. The optical sensor 45 detects, in particular, the moisture content of the front face MA.

The optical sensor 45 is disposed upstream of the generators 33 in the transporting direction. The optical sensor 45 faces the medium M being transported. The optical sensor 45 is disposed above the medium M.

Figure 7:
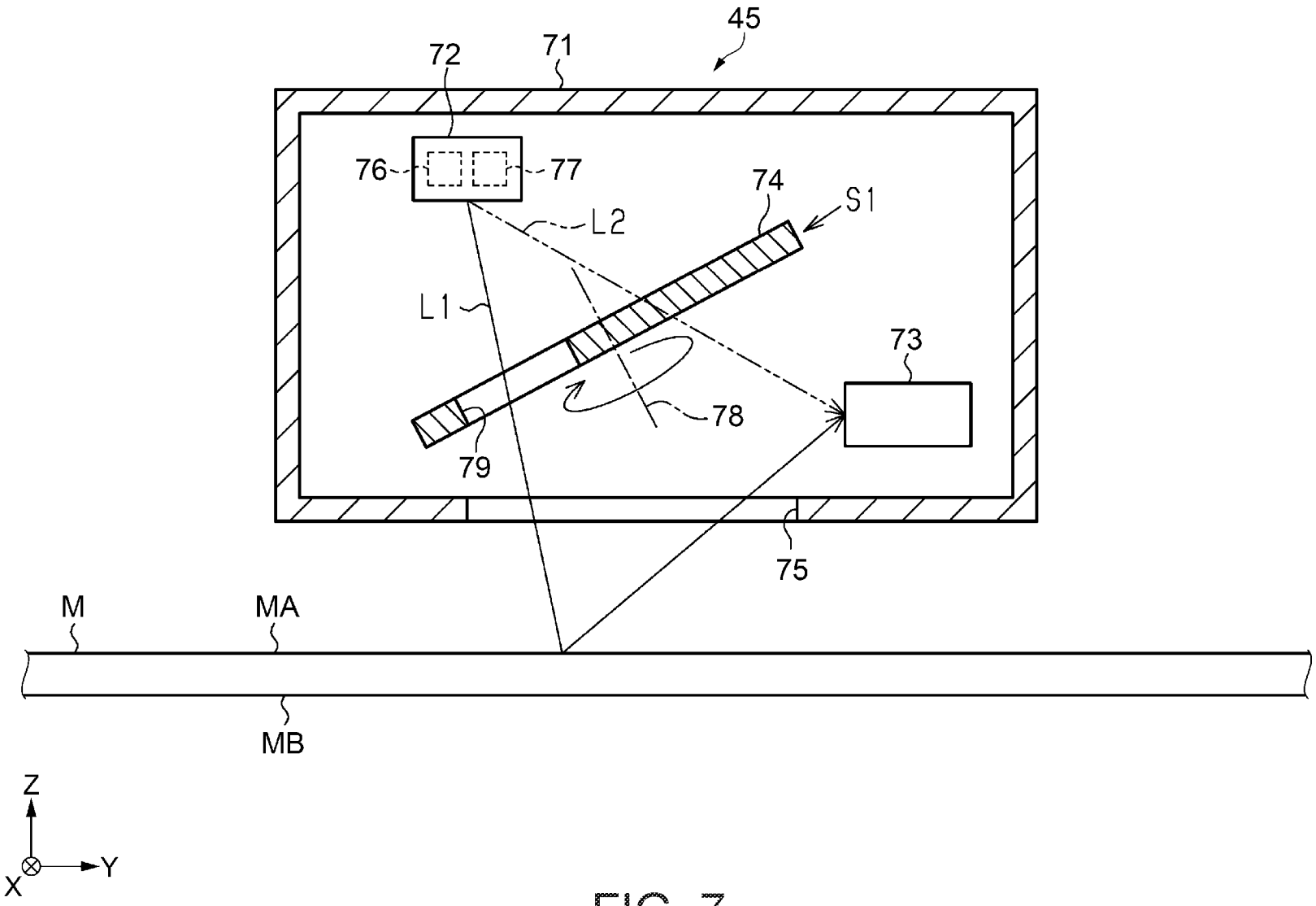
FIG. 7 is a schematic diagram showing configuration of the detector (optical sensor).
Figure 8:
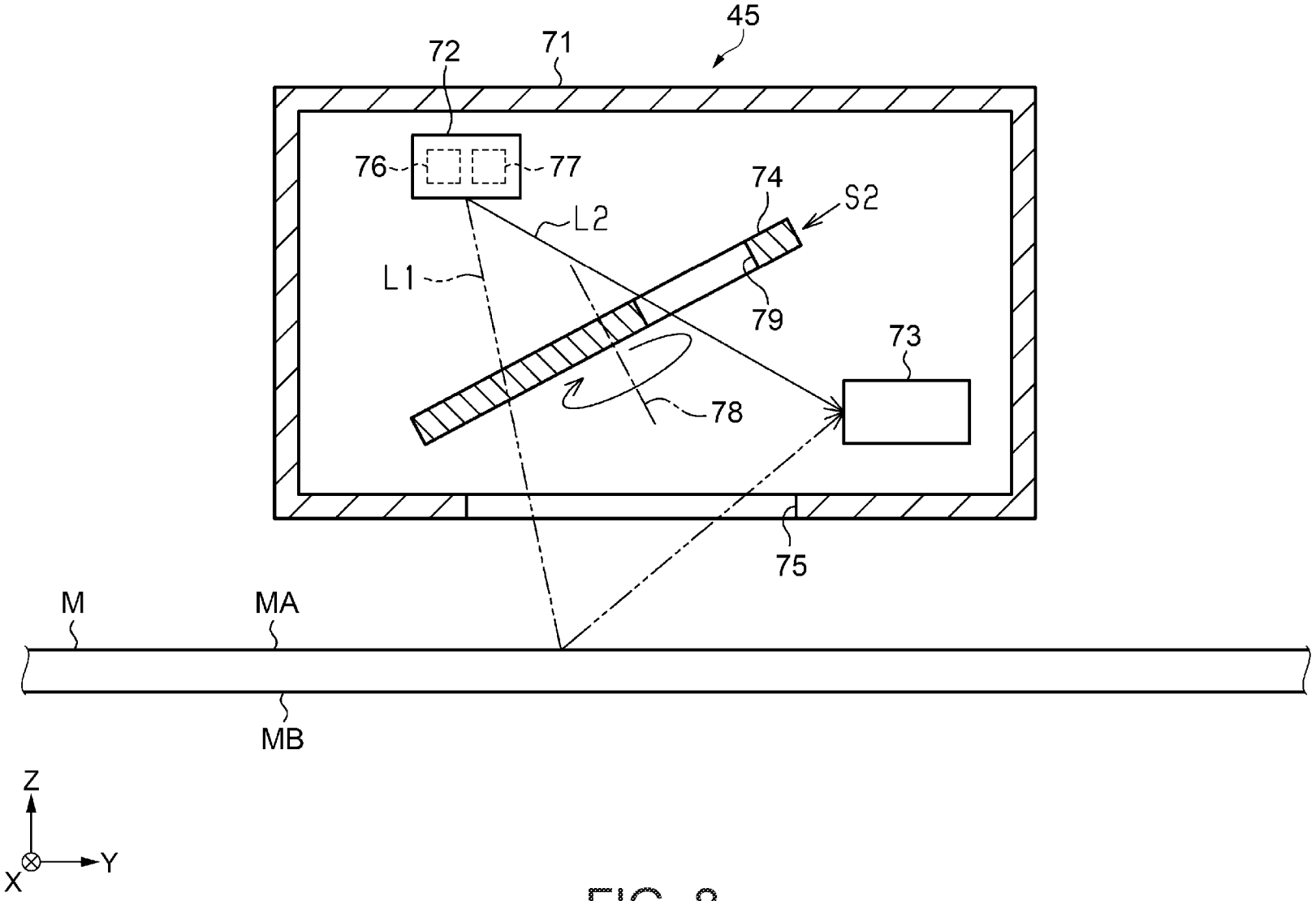
FIG. 8 is a schematic diagram showing configuration of a detector (optical sensor).

As shown in FIGS. 7 and 8, the optical sensor 45 includes a case 71, a light source 72, and a light receiver 73. The optical sensor 45 has a light shielding portion 74. The optical sensor 45 is a reflective optical sensor.

The case 71 houses the light source 72, the light receiver 73, and the light shielding portion 74. The shape of the case 71 is, for example, rectangular parallelepiped or a rectangular solid shape. The case 71 has an opening 75. The opening 75 is provided in a side surface of the case 71 facing the medium M. That is, the opening 75 is provided in the lower portion of the case 71. The inside of the case 71 and the outside of the case 71 are in communication with each other through the opening 75.

The light source 72 emits light. The light source 72 emits light having an absorption wavelength of water as a peak wavelength. For example, the light source 72 is configured to emit light having peak wavelengths of 900 nm or more and 2100 nm or less. The light source 72 of the present embodiment emits near-infrared light.

The light source 72 emits light downward. Therefore, the light source 72 irradiates the medium M with light. The light source 72 emits light to the medium M on which liquid has been applied by the head 15. At this time, the light source 72 irradiates the front face MA of the medium M with light.

The light source 72 includes one or a plurality of light emitting elements that emit light. The light source 72 includes a plurality of light emitting elements. Specifically, the light source 72 includes a plurality of light emitting elements having different peak wavelengths. The light emitting elements are, for example, LEDs. The light source 72 includes, for example, a first light emitting element 76 and a second light emitting element 77. The light source 72 may include three or more light emitting elements.

The first light emitting element 76 is, for example, a light emitting element that emits light having a peak wavelength of 940 nm. 940 nm is an absorption wavelength of water. The second light emitting element 77 is, for example, a light emitting element that emits light having a peak wavelength of 1450 nm. 1450 nm is an absorption wavelength of water. The first light emitting element 76 and the second light emitting element 77 may be any light emitting elements that emit light having a peak wavelength corresponding to an absorption wavelength of water. For example, the peak wavelengths may be 1800 nm, 1940 nm, or 2100 nm.

The light receiver 73 receives light emitted by the light source 72. The light receiver 73 includes, for example, a light receiving element. The light receiving element is, for example, a photodiode. The light receiver 73 receives light traveling along a detection optical path L1 from the light source 72 or light traveling along a reference optical path L2 from the light source 72. That is, the light emitted from the light source 72 falls incident on the light receiver 73 by travelling along the detection optical path L1 or the reference optical path L2.

The detection optical path L1 is an optical path wherein light emitted from the light source 72 falls incident on the light receiver 73 by reflecting off the medium M. The detection optical path L1 is the optical path indicated by a solid line in FIG. 7 and two dot chain line in FIG. 8. The detection optical path L1 extends between the inside of the case 71 and the outside of the case 71 through the opening 75. The detection optical path L1 extends from the light source 72 to the medium M and then extends from the medium M to the light receiver 73.

Light traveling in the detection optical path L1 first strikes the medium M by passing from the light source 72 through the opening 75. At this time, the light traveling along the detection optical path L1 hits the front face MA of the medium M. The light striking the front face MA of the medium M is reflected by the front face MA of the medium M. Light reflected by the front face MA of the medium M falls incident on the light receiver 73 by passing through the opening 75. In this manner, the light emitted by the light source 72 travels along the detection optical path L1. As a result, the light receiver 73 receives the light reflected by the medium M.

The reference optical path L2 is an optical path along which light emitted from the light source 72 is incident on the light receiver 73 without being reflected by the medium M supported by the platen 11. The reference optical path L2 is the optical path indicated by a alternate long and a two dot chain line in FIG. 7 and by a solid line in FIG. 8. The reference optical path L2 extends inside the case 71. The reference optical path L2 extends straight from the light source 72 to the light receiver 73 inside the case 71. Therefore, the light traveling along the reference optical path L2 is directly incident on the light receiver 73 from the light source 72. Thus, the light receiver 73 directly receives the light emitted by the light source 72.

The light shielding portion 74 is configured to block light emitted by the light source 72. The shape of the light shielding portion 74 is, for example, a flat plate or a flat plate shape. The light shielding portion 74 is located between the light source 72 and the light receiver 73 inside the case 71. For example, the light shielding portion 74 is positioned so as to extend across the detection optical path L1 and the reference optical path L2. The light shielding portion 74 closes the detection optical path L1 or the reference optical path L2. The light shielding portion 74 blocks light emitted from the light source 72 by closing the detection optical path L1 or the reference optical path L2.

The light shielding portion 74 is configured to be switched between a first state S1 and a second state S2. The light shielding portion 74 illustrated in FIG. 7 is in the first state S1. The light shielding portion 74 illustrated in FIG. 8 is in the second state S2.

The light shielding portion 74 is switched between the first state S1 and the second state S2 by being displaced, for example. The light shielding portion 74 is configured to rotate about a rotation axis 78 which is a virtual axis. The light shielding portion 74 is switched between the first state S1 and the second state S2 by rotating about the rotation axis 78. The light shielding portion 74 is supported by the case 71 so as to be rotatable about the rotation axis 78, for example.

The light shielding portion 74 has a through hole 79. When the light shielding portion 74 is in the first state S1, the through hole 79 is located on the detection optical path L1. Therefore, when the light shielding portion 74 is in the first state S1, light from the light source 72 traveling along the detection optical path L1 passes through the through hole 79 and is incident on the light receiver 73. That is, when the light shielding portion 74 is in the first state S1, the light shielding portion 74 allows the light emitted by the light source 72 to travel along the detection optical path L1. When the light shielding portion 74 is in the first state S1, the through hole 79 is not located on the reference optical path L2. That is, when the light shielding portion 74 is in the first state S1, the light shielding portion 74 does not allow the light emitted by the light source 72 to travel along the reference optical path L2. In this way, the first state S1 of the light shielding portion 74 is a state in which the light shielding portion 74 does not block the detection optical path L1 and the light shielding portion 74 blocks the reference optical path L2.

When the light shielding portion 74 is in the second state S2, the through hole 79 is located on the reference optical path L2. Therefore, when the light shielding portion 74 is in the second state S2, light from the light source 72 traveling along the reference optical path L2 passes through the through hole 79 and is incident on the light receiver 73. That is, when in the second state S2, the light shielding portion 74 allows the light emitted by the light source 72 to travel along the reference optical path L2. When the light shielding portion 74 is in the second state S2, the through hole 79 is not located on the detection optical path L1. That is, when in the second state S2, the light shielding portion 74 does not allow the light emitted by the light source 72 to travel along the detection optical path L1. In this way, the second state S2 of the light shielding portion 74 is a state in which the light shielding portion 74 blocks the detection optical path L1 and the light shielding portion 74 does not block the reference optical path L2.

The light shielding portion 74 determines the optical path along which the light emitted from the light source 72 travels by switching between the first state S1 and the second state S2. The control unit 100 switches the light shielding portion 74 between the first state S1 and the second state S2.

When the medium M is irradiated with light from the light source 72, that is, when light traveling along the detection optical path L1 hits the medium M, a part of the light is absorbed by the medium M. In particular, near-infrared light emitted by the light source 72 is easily absorbed by water. Therefore, when the amount of moisture contained in the medium M is large, the amount of light absorbed by the medium M is large. In contrast, when the amount of moisture contained in the medium M is small, the amount of light absorbed by the medium M is small.

The intensity of the light reflected by the medium M is detected by the light receiver 73 receiving the light traveling along the detection optical path L1. When the light receiver 73 receives the light traveling along the reference optical path L2, the intensity of light that the light source 72 irradiates on the medium M is detected. The reflectance of light with respect to the medium M is detected based on the intensity of light traveling along the detection optical path L1 and the intensity of light traveling along the reference optical path L2. Here, the reflectance of light with respect to the medium M is a ratio of light reflected by the medium M to light irradiated on the medium M.

There is a correlation between the reflectance of light with respect to the medium M and the amount of moisture contained in the medium M. For example, the greater the reflectance of light with respect to the medium M, the smaller the amount of moisture contained in the medium M. The smaller the reflectance of light with respect to the medium M, the larger the amount of moisture contained in the medium M. In this manner, the amount of moisture contained in the medium M is detected based on the reflectance of light with respect to the medium M. Therefore, the optical sensor 45 is a sensor that detects the amount of moisture contained in the medium M after printing. In particular, the optical sensor 45 can accurately detect the amount of moisture of the front face MA. The control unit 100 may calculate the amount of moisture contained in the medium M based on the signal transmitted from the optical sensor 45.

The optical sensor 45 mainly detects the amount of moisture contained in the front face MA of the medium M, while the capacitance sensors 43, 44 mainly detect the amount of moisture contained in the back face MB of the medium M and the inside of the medium M. Therefore, the amount of moisture contained in the medium M is accurately detected by the optical sensor 45 and the capacitance sensors 43, 44.

When the head 15 ejects liquid onto the medium M, most of the liquid may remain on the front face MA of the medium M. In this case, by referring to the detection result of the capacitance sensor 43, it can be understood that the increase in the amount of moisture included in the medium M is small with respect to the amount of liquid ejected by the head 15. On the other hand, by referring to detection results of the capacitance sensor 43 and detection results of the optical sensor 45, since liquid remains on the front face MA of the medium M, it can be understood that an increase in the amount of moisture included in the medium M is large with respect to the amount of liquid ejected by the head 15. From the above, it is understood that the medium M has a characteristic of having difficulty absorbing liquid. In this manner, the characteristics of the medium M can be grasped based on the detection results of the capacitance sensor 43 and the detection results of the optical sensor 45.

The optical sensor 45 may be disposed downstream of the generators 33 in the transporting direction. In this way, it is possible to detect the amount of moisture on the front face MA of the medium M after drying.

Next, a configuration of the control unit 100 of the drying device 20 will be described.

Figure 9:
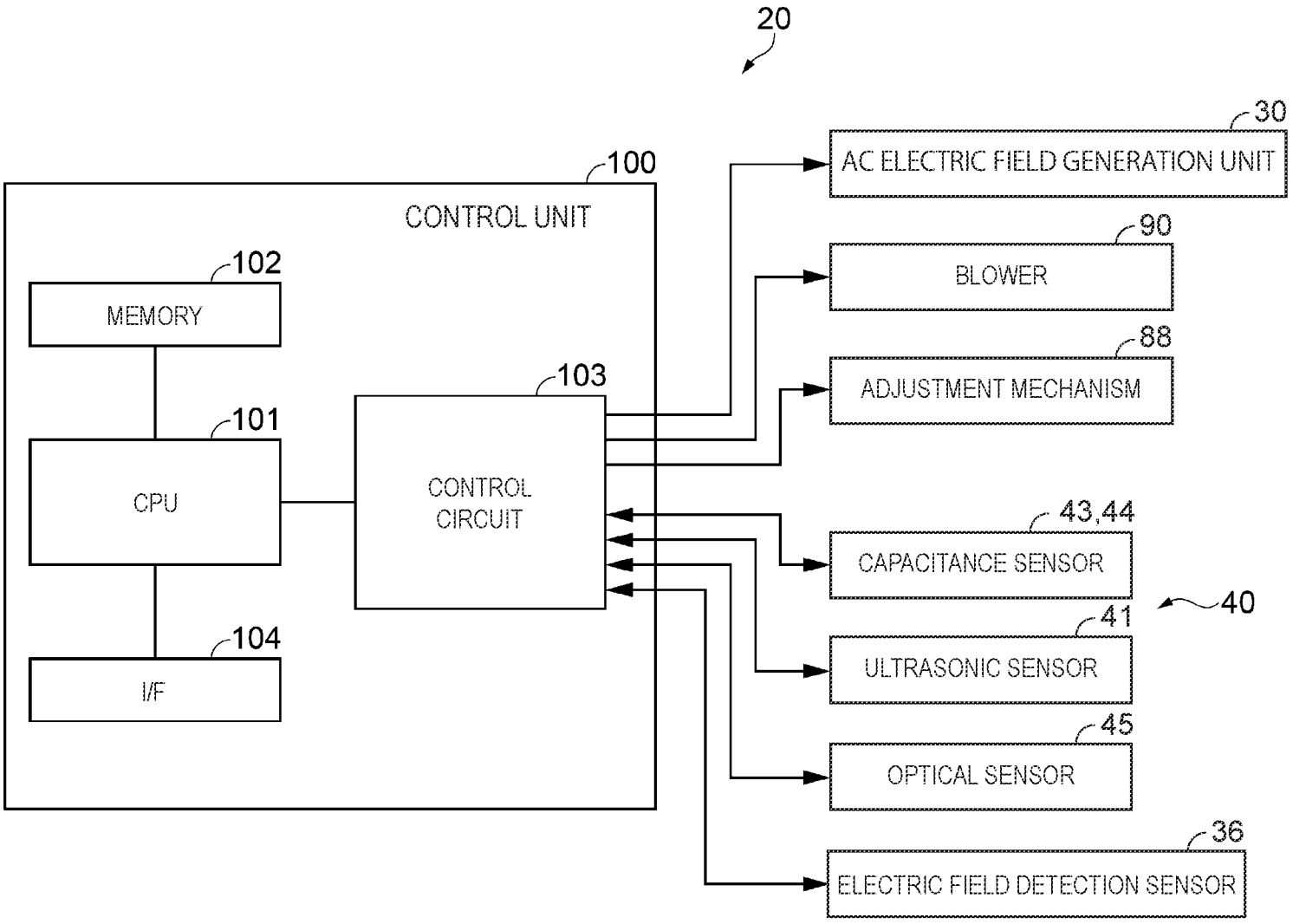
FIG. 9 is a block diagram showing configuration of a control unit of a drying device.

As shown in FIG. 9, the control unit 100 controls each driving unit of the drying device 20. The control unit 100 includes a CPU 101, a memory 102, a control circuit 103, and an interface (I/F) 104. The CPU 101 is an arithmetic processing unit. The memory 102 is a storage device that secures an area for storing CPU 101 programs, a work area, or the like. It has a storage element such as RAM or EEPROM. When drying treatment data or the like is acquired externally such as from an information processing terminal via I/F 104, the CPU 101 via the control circuit 103 controls the AC electric field generation unit 30, the blower 90, the adjustment mechanism 88, the detector 40 (the ultrasonic sensor 41, the capacitance sensors 43, 44, and the optical sensor 45), and the electric field detection sensor 36. The control unit 100 can control the holding device 2 and the winding device 3 in cooperation with the control unit 13.

The control unit 100 controls the AC electric field generation unit 30 according to the detection results of the detector 40. For example, when, based on detection data detected by the detector 40, the amount of moisture contained in the medium M reaches a threshold value, the control unit 100 drives the AC electric field generation unit 30. On the other hand, when the amount of moisture contained in the medium M does not reach the threshold value, that is, when the amount of moisture contained in the medium M is small, drive of the AC electric field generation unit 30 is stopped. As a result, a dry medium M with a low moisture content will not be heated, and thus it is possible to avoid a failure of the AC electric field generation unit 30.

Further, the control unit 100 regulates drive of the AC electric field generation unit 30 based on the signal from the electric field detection sensor 36.

Figure 10:
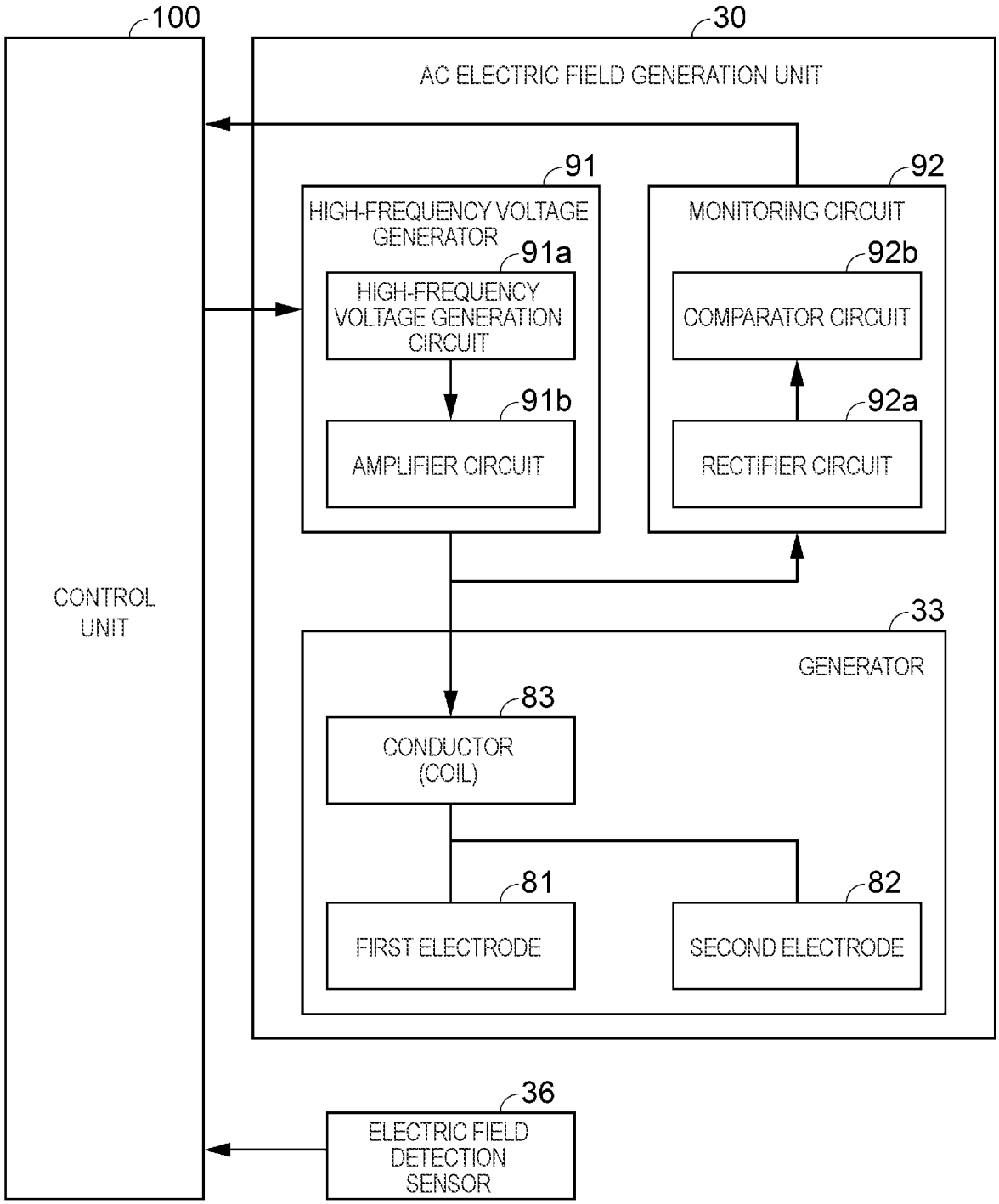
FIG. 10 is a block diagram showing configuration of the control unit of the drying device.

As shown in FIG. 10, the AC electric field generation unit 30 includes a monitoring circuit 92 in addition to the generators 33 and the high-frequency voltage generator 91.

The high-frequency voltage generator 91 is coupled to the generators 33. Specifically, the high-frequency voltage generator 91 is coupled to the first electrode 81 and the second electrode 82 via the conductor 83. The high-frequency voltage generator 91 generates a high-frequency voltage at the first electrode 81 and the second electrode 82 and, by outputting the high-frequency voltage to the first electrode 81 and the second electrode 82, generates an AC electric field from the first electrode 81 and the second electrode 82.

The high-frequency voltage generator 91 includes a high-frequency voltage generation circuit 91*a* and an amplifier circuit 91*b*. The high-frequency voltage generation circuit 91*a* is coupled to the control unit 100 and the amplifier circuit 91*b*. The high-frequency voltage generation circuit 91*a* is a circuit that generates a high-frequency voltage based on generation instruction signals from the control unit 100 and outputs the high-frequency voltage to the amplifier circuit 91*b*. The amplifier circuit 91*b* amplifies the high-frequency voltage generated by the high-frequency voltage generation circuit 91*a* based on generation instruction signals from the control unit 100, and outputs the amplified high-frequency voltage to the generators 33. The high-frequency voltage generator 91 supplies power of, for example, 3 kW or less to the generators 33.

The monitoring circuit 92 is coupled to the high-frequency voltage generator 91 and the control unit 100. The monitoring circuit 92 monitors the high-frequency voltage from the high-frequency voltage generator 91, and outputs the result of monitoring the high-frequency voltage to the control unit 100.

The monitoring circuit 92 includes a rectifier circuit 92*a* and a comparator circuit 92*b*. The rectifier circuit 92*a* is coupled to the high-frequency voltage generator 91 and the comparator circuit 92*b*. The rectifier circuit 92*a* rectifies and smooths the high-frequency voltage from the high-frequency voltage generator 91 to convert the high-frequency voltage into a direct current, and outputs the direct current to the comparator circuit 92*b*.

The comparator circuit 92*b* is coupled to the rectifier circuit 92*a* and the control unit 100. The comparator circuit 92*b* compares signals output from the rectifier circuit 92*a* with a reference voltage and when the signals output from the rectifier circuit 92*a* exceed the reference voltage, the comparator circuit 92*b* outputs signals indicating that the reference voltage has been exceeded to the control unit 100.

The monitoring circuit 92 uses the characteristic of the coil 85 that its electrical resistance, that is, its impedance, changes due to abnormal heat generation of the coil 85 to monitor the high-frequency voltage input to the generators 33. When the high-frequency voltage exceeds the reference voltage, the monitoring circuit 92 assumes that the temperature of the coil 85 rose and the monitoring circuit 92 detects that abnormal heat generation has occurred in the generators 33. In particular, there are cases where the temperature of the generators 33 rises due to heat generation of the coil 85, and abnormal heat generation of the generators 33 can be detected if the temperature fluctuation of the coil 85 can be grasped. More specifically, the coil 85 is made of copper. The electrical resistance of copper changes greatly in accordance with temperature changes. If there is a temperature rise at least of substantially 50° C., a simple circuit can detect the change in electrical resistance.

In the monitoring circuit 92, a diode for rectification and a capacitor for smoothing are used in the rectifier circuit 92*a*, and a Zener diode for generating the reference voltage is used in the comparator circuit 92*b*. Even when the frequency of the AC electric field generated by the generators 33 changes due to aging or the like, the electrical resistance of the generators 33, particularly the electrical resistance of the coil 85, changes, so that the monitoring circuit 92 can detect the occurrence of an abnormality related to the generators 33. The monitoring circuit 92 detects a change in the impedance of the generators 33 including the conductor 83, the first electrode 81, and the second electrode 82, and detects the temperature of at least one of the conductor 83, the first electrode 81, and the second electrode 82 based on the detected change in impedance of the generators 33.

When a restriction condition is met at the start of printing, the control unit 100 stops the start of printing. When printing is started and printing is being performed, if the restriction condition is met, the control unit 100 stops printing. As a result, a failure of the AC electric field generation unit 30 can be avoided.

Although the printing system 1 has been described as an example in the present embodiment, the present disclosure is not limited thereto. For example, the printing device 10 may be replaced with another processing apparatus that applies liquid to a medium M. Even in this case, the same effects as described above can be obtained.

Further, the same effects as described above can be obtained even when the drying device 20 is used alone instead of in the printing system 1. That is, a failure of the AC electric field generation unit 30 can be avoided.

Next, another embodiment will be described.

The AC electric field generation unit 30 in the drying device 20 of the above embodiment is configured to generate an AC electric field of one type of frequency band, but is not limited thereto. A configuration may be adopted in which any frequency band AC electric field from among a plurality of types of frequency band AC electric fields can be selectively generated.

That is, the AC electric field generation unit 30 of the drying device 20 includes a first AC electric field generator for generating an AC electric field of a first frequency band and a second AC electric field generator for generating an AC electric field of a second frequency band and the control unit 100 drives the first AC electric field generator or the second AC electric field generator according to the detection result of the detector 40.

For example, the first AC electric field generator generates an AC electric field in a first frequency band of 915 MHz, and the second AC electric field generator generates an AC electric field in a second frequency band of 2.4 GHz. In this case, the first AC electric field generator includes a first system generators and a high-frequency voltage generator for generating the AC electric field in the first frequency band. The second AC electric field generator includes a second system generators and a high-frequency voltage generator for generating the AC electric field of the second frequency band. The first system generators and the second system generators are alternately arranged so as to be adjacent to each other. As a result, variations in the intensity of the AC electric field with respect to a unit area of the medium M can be suppressed.

When generating the AC electric field in the first frequency band, the control unit 100 controls the first system high-frequency voltage generator to generate the AC electric field in the first frequency band from the first system generators. When generating the AC electric field of the second frequency band, the control unit 100 controls the second system high-frequency voltage generator to generate the AC electric field in the second frequency band from the second system generators.

Accordingly, by selectively generating any one of a plurality of types of alternating electric fields having different frequencies, the AC electric field generation unit 30 can change, in accordance with the frequency, the heating depth in the thickness direction of the liquid discharged onto the medium M. This makes it possible to efficiently dry the medium M by heating the liquid in accordance with the state of the medium M, such as by changing the frequency in accordance with the amount of moisture contained in the medium M.

What is claimed is:

1. A drying device that dries a medium being transported, the drying device comprising:

a support that supports the medium being transported;

an AC electric field generation unit that generates an AC electric field;

a detector that detects an amount of moisture contained in the medium; and a control unit, wherein the AC electric field generation unit includes:

a first electrode and a second electrode disposed adjacent to each other and facing the medium supported by the support;

a high-frequency voltage generator that generates a high-frequency voltage at the first electrode and the second electrode, and a conductor that electrically couples the first electrode and the second electrode to the high-frequency voltage generator, the detector is disposed at least one of downstream or upstream of the first electrode and the second electrode in a transporting direction, and the control unit controls the AC electric field generation unit in accordance with a detection result of the detector.

2. The drying device according to claim 1, wherein surfaces of the first electrode and the second electrode facing the medium are covered by a cover transmittable by the AC electric field.

3. The drying device according to claim 1, further comprising:

a blower configured to blow air to the first electrode and to the second electrode.

4. The drying device according to claim 1, wherein the detector includes:

a capacitance sensor having an electrode pair and configured to detect a capacitance of the medium contacting the electrode pair;

an ultrasonic sensor having a transmitting unit that transmits ultrasonic waves and a receiving unit that is disposed to face the transmission unit via the medium and that is configured to receive the ultrasonic waves transmitted by the transmitting unit.

5. The drying device according to claim 4, wherein the electrode pair contacts a surface of the medium opposite to a surface facing the first electrode and the second electrode.

6. The drying device according to claim 1, wherein the AC electric field generation unit has a first AC electric field generator configured to generate an AC electric field of a first frequency band and a second AC electric field generator configured to generate an AC electric field of a second frequency band, and the control unit is configured to drive the first AC electric field generator or the second AC electric field generator according to a detection result of the detector.

7. A printing system comprising:

the drying device according to claim 1; and a printing device for applying a liquid to a medium, wherein the drying device dries the medium to which the liquid has been applied by the printing device.

* * * * *